US009414142B1

(12) United States Patent
Zauhar et al.

(10) Patent No.: US 9,414,142 B1
(45) Date of Patent: Aug. 9, 2016

(54) WIRELESS BATH FAN SPEAKER

(71) Applicant: Chien Luen Industries Co., Ltd., Inc., Oakland Park, FL (US)

(72) Inventors: Zachary Zauhar, Dania Beach, FL (US); Willard Passauer, Fort Lauderdale, FL (US); Eliezer Rivera, Plantation, FL (US); Tien S. Lowe, Cooper City, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 124 days.

(21) Appl. No.: 14/478,300

(22) Filed: Sep. 5, 2014

Related U.S. Application Data

(60) Provisional application No. 61/874,689, filed on Sep. 6, 2013.

(51) Int. Cl.
*H04R 27/00* (2006.01)
*H04R 1/02* (2006.01)

(52) U.S. Cl.
CPC ..... *H04R 1/025* (2013.01); *H04R 2201/021* (2013.01)

(58) Field of Classification Search
None
See application file for complete search history.

(56) References Cited

U.S. PATENT DOCUMENTS 1,823,479 A 9/1931 Venderbush
2,519,503 A 8/1950 Rigaumont
2,689,906 A 9/1954 Corbett
2,697,163 A 12/1954 Spear
2,950,859 A 8/1960 Kirk
3,068,341 A 12/1962 Ortiz
3,125,943 A 3/1964 Geocaris et al.
3,246,137 A 4/1966 Zagel
3,665,838 A 5/1972 Shepherd
3,785,271 A 1/1974 Joy
4,510,851 A 4/1985 Sarnosky
4,526,318 A 7/1985 Fleming et al.
4,537,117 A 8/1985 Cavestany et al.
4,589,476 A 5/1986 Berner
4,657,291 A 4/1987 Kurosaki
4,681,024 A 7/1987 Ivey
4,726,559 A 2/1988 Hultmark
4,867,640 A 9/1989 Penlesky
5,232,152 A 8/1993 Tsang
5,620,370 A 4/1997 Umai et al.
5,934,783 A 8/1999 Yoshikawa
6,161,175 A 12/2000 Kim
6,215,885 B1 4/2001 Geiger
6,261,175 B1 7/2001 Larson (Continued)

OTHER PUBLICATIONS

Tom, Lawrence, Office Action Summary mailed Nov. 7, 2014 for U.S. Appl. No. 13/289,312, filed Nov. 4, 2011, 14 pages.

(Continued)

*Primary Examiner* — Muhammad N Edun
(74) *Attorney, Agent, or Firm* — Brian S. Steinberger; Law Offices of Brian S. Steinberger, P.A.

(57) ABSTRACT

Apparatus, devices, housings, systems and methods for providing wireless speakers in bathroom ventilation exhaust fans mounted in ceilings and walls. A main housing can house both the ventilation fan and the speaker separately from one another. The wireless speaker can use the same power source as the fan, and can be separately controlled. Wireless technologies such as Bluetooth, Wi Fi and Zigbee can be used.

19 Claims, 12 Drawing Sheets

(56) References Cited

U.S. PATENT DOCUMENTS

| | | | |
|---|---|---|---|
| 6,329,908 | B1 | 12/2001 | Frecska |
| 6,340,237 | B1 | 1/2002 | Koga et al. |
| D457,232 | S | 5/2002 | Miura |
| D457,616 | S | 5/2002 | Yamanaka |
| 6,384,352 | B1 | 5/2002 | Ellman |
| 6,488,579 | B2 | 12/2002 | Larson |
| 6,538,881 | B1 | 3/2003 | Jeakins |
| 6,632,006 | B1 | 10/2003 | Rippel et al. |
| 6,802,770 | B2 | 10/2004 | Larson |
| 6,897,580 | B2 | 5/2005 | White |
| 6,979,169 | B2 | 12/2005 | Penlesky |
| D521,145 | S | 5/2006 | Craw |
| 7,128,303 | B2 | 10/2006 | Penlesky |
| D535,433 | S | 1/2007 | Craw |
| 7,175,309 | B2 | 2/2007 | Craw |
| 7,203,416 | B2 | 4/2007 | Craw |
| D565,716 | S | 4/2008 | Jacak |
| D575,387 | S | 8/2008 | Zakula |
| D577,805 | S | 9/2008 | Adrian |
| D581,508 | S | 11/2008 | Miyake |
| 7,455,432 | B2 | 11/2008 | Craw |
| 7,455,500 | B2 | 11/2008 | Penlesky |
| 7,481,559 | B1 | 1/2009 | Rashidi |
| 7,591,867 | B2 | 9/2009 | Choi et al. |
| 7,606,379 | B2 | 10/2009 | Ivey |
| 7,654,495 | B2 | 2/2010 | Adrian |
| 7,677,964 | B1 | 3/2010 | Bucher et al. |
| 7,845,803 | B2 | 12/2010 | Lv et al. |
| 7,881,827 | B2 | 2/2011 | Park |
| 7,922,335 | B2 | 4/2011 | Sakai et al. |
| 7,993,037 | B1 | 8/2011 | Buse |
| D653,323 | S | 1/2012 | Jacak |
| 8,104,502 | B2 | 1/2012 | Nakata et al. |
| D654,998 | S | 2/2012 | Zakula |
| 8,113,148 | B2 | 2/2012 | Chem |
| 8,172,655 | B2 | 5/2012 | Liu |
| 8,218,805 | B2 | 7/2012 | Hornback |
| 8,295,504 | B2 | 10/2012 | Ady |
| D681,249 | S | 4/2013 | Tom |
| 8,485,696 | B2 | 7/2013 | Pringle |
| 8,591,037 | B2 | 11/2013 | Nagumo et al. |
| 8,961,126 | B1 | 2/2015 | Tom |
| 9,022,846 | B1 | 5/2015 | Tom |
| 9,097,265 | B1 | 8/2015 | Tom |
| 9,103,104 | B1 | 8/2015 | Tom |
| 9,188,132 | B1 | 11/2015 | Tom |
| 2005/0006549 | A1 | 1/2005 | Liu |
| 2005/0111972 | A1 | 5/2005 | Penlesky et al. |
| 2006/0172693 | A1 | 8/2006 | Lundquist |
| 2006/0199515 | A1 | 9/2006 | Lasko et al. |
| 2007/0131827 | A1 | 6/2007 | Nevers et al. |
| 2008/0261508 | A1 | 10/2008 | Deng |
| 2008/0318515 | A1 | 12/2008 | Yeung |
| 2009/0028372 | A1 | 1/2009 | Cerasuolo |
| 2009/0073702 | A1 | 3/2009 | Craw |
| 2009/0116189 | A1 | 5/2009 | Chang et al. |
| 2009/0170421 | A1 | 7/2009 | Adrian |
| 2010/0009621 | A1 | 1/2010 | Hsieh |
| 2010/0171681 | A1 | 7/2010 | Cabanas |
| 2010/0226139 | A1 | 9/2010 | Lynch |
| 2012/0250335 | A1 | 10/2012 | Nakano |
| 2012/0274767 | A1 | 11/2012 | Hornback |
| 2013/0084793 | A1 | 4/2013 | Yang |
| 2013/0114826 | A1 | 5/2013 | Chang |
| 2014/0177900 | A1 * | 6/2014 | Berkman ..... H04R 1/021 381/391 |

OTHER PUBLICATIONS

Tom, Lawrence, Listing of pending claims for U.S. Appl. No. 13/289,312, filed Nov. 4, 2011, 7 pages.

Tom, Lawrence, Office Action Summary mailed Oct. 22, 2014 for U.S. Appl. No. 13/042,992, filed Mar. 8, 2011, 16 pages.

Tom, Lawrence, Listing of pending claims for U.S. Appl. No. 13/042,992, filed Mar. 8, 2011, 7 pages.

Tom, Lawrence, Office Action mailed Jan. 8, 2015 for U.S. Appl. No. 13/233,700, filed Sep. 15, 2011, 25 pages.

Tom, Lawrence, Amendment Response filed Oct. 3, 2014 for U.S. Appl. No. 13/233,700, filed Sep. 15, 2011, 13 pages.

* cited by examiner

WIRELESS BATH FAN SPEAKER

This application claims the benefit of priority of U.S. Provisional Patent Application Ser. No. 61/874,689 filed Sep. 6, 2013, the subject matter of which is incorporated by reference in its' entirety.

FIELD OF INVENTION

This invention relates ventilation exhaust fans, and in particular to apparatus, devices, housings, systems and methods for providing wireless speakers in bathroom ventilation exhaust fans mounted in ceilings and walls.

BACKGROUND AND PRIOR ART

Various types of bathroom ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

Often there is a need to have a speaker system in bathrooms for so that music and/or communication purposes. However, it can be difficult to retrofit a bathroom to include a speaker system. For example, the added speaker may have to be surface mounted and as a result can be unsightly. Additionally, speaker systems generally require hardwiring to a sound source. Additionally, speakers may require a separate power source that also requires separate hardwiring to power source. Adding wiring can add additional labor and material expense and can result in unsightly wire connections.

Adding a speaker system to an existing bath fan can be difficult since there is little or no space in the housings of the bath fan. Additionally, noise from the ventilation fan itself can cause distortion to the speaker sound system. Still further problems would include being able to activate the speaker system separately from the ventilation fan since the fans have one switch, and it would be undesirable to constantly turn the speaker system on and off with the fan.

Thus, the need exists for solutions to the above problems with the prior art.

SUMMARY OF THE INVENTION

A primary objective of the present invention is to provide apparatus, devices, housings, systems and methods for providing wireless speakers in bathroom ventilation fans mounted in ceilings and walls, that uses wireless technologies such as but not limited to Wi-FI, Bluetooth and Zigbee.

A secondary objective of the present invention is to provide apparatus, devices, housings, systems and methods for providing wireless speaker mounted inside of bathroom ventilation fans.

A third objective of the present invention is to provide apparatus, devices, housings, systems and methods for providing wireless speaker system in bathroom ventilation fans that uses the same power source as a bathroom ventilation fan so that no new outside power source wiring is needed.

A fourth objective of the present invention is to provide apparatus, devices, housings, systems and methods for providing wireless speaker for bathroom ventilation fans that only requires a single installation of the bathroom ventilation fan as opposed to two separate installations.

A fifth objective of the present invention is to provide apparatus, devices, housings, systems and methods for providing wireless speaker systems for bathroom ventilation fans with the speaker located in front of the ventilation fan removing risk of sound distortion by fan blade movement.

A sixth objective of the present invention is to provide apparatus, devices, housings, systems and methods for providing wireless speaker system for bathroom ventilation fans having separate controls that active the speaker and fan separately.

A seventh objective of the present invention is to provide apparatus, devices, housings, systems and methods for providing wireless speaker systems for bathroom ventilation fans that can be connected to public address (PA) systems.

An embodiment of a ceiling mounted ventilation fan with speaker system can include a single housing closed sides, closed top and an open bottom, a fan inside of the housing for drawing air through the open bottom into the housing and exhausting out of a side exhaust port through one of the closed sidewalls of the housing, a motor for operating the fan, a wireless speaker inside of the housing in front of the ventilation fan, and a single power source for providing power to both the motor and the wireless speaker so that the fan and the speaker are being powered by the same power source, and the fan is useful as a ceiling ventilation fan.

The ceiling mounted ventilation fan can include a main grill covering the open bottom. The main grill can include a separate speaker grill covering an opening in the main grill for protecting the speaker.

The ceiling mounted ventilation fan can include an enclosure for the speaker. The wireless speaker can include a transmitter and receiver operating with a wireless technology, selected from the group consisting of Wi-Fi, Bluetooth and Zigbee.

The ceiling mounted ventilation fan can include a control for operating the wireless speaker separately from the fan.

The ceiling mounted ventilation fan can include a remote control for operating the wireless speaker separately from the fan.

The ceiling mounted ventilation fan can include a home entertainment system remotely supplying music to the speaker.

The ceiling mounted ventilation fan can include a public address (PA) system remotely providing messages to the wireless speaker.

The wireless speaker can include a speaker enclosure having an opening for supporting a rear end of a speaker by a speaker mount; and a separate speaker grill in the main grill for the speaker, wherein the speaker enclosure and speaker mount prevents incoming air through the grill from passing about the speaker.

The ceiling mounted ventilation fan can include a single power supply for supplying power to both the fan and wireless speaker inside the single housing.

The ceiling mounted ventilation fan can include an enclosure inside the single housing for enclosing both a wireless receiver module and a power converter.

The ceiling mounted ventilation fan can include a junction box for connecting the supplied power to both the fan and the wireless speaker. The junction box can include male and female plugs for attaching and detaching the supplied power to both the fan and the wireless speaker.

The housing can include a top chassis and a bottom chassis attached to one another. The top chassis can include a first side wall, a second side wall spaced opposite to and parallel to the first side wall, and a top wall for attaching the first side wall to the second side wall. The bottom chassis can include a first side wall, a second side wall spaced opposite to and parallel to the first side wall, a first support beam for attaching one side edge of the first side wall to one side edge of the second side wall, and a second support beam for attaching another side edge of the first side wall to another side edge of the second side wall.

The ventilation fan can be a bath fan.

The speaker can be located between the grill and the fan, and the fan can include a blower wheel.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
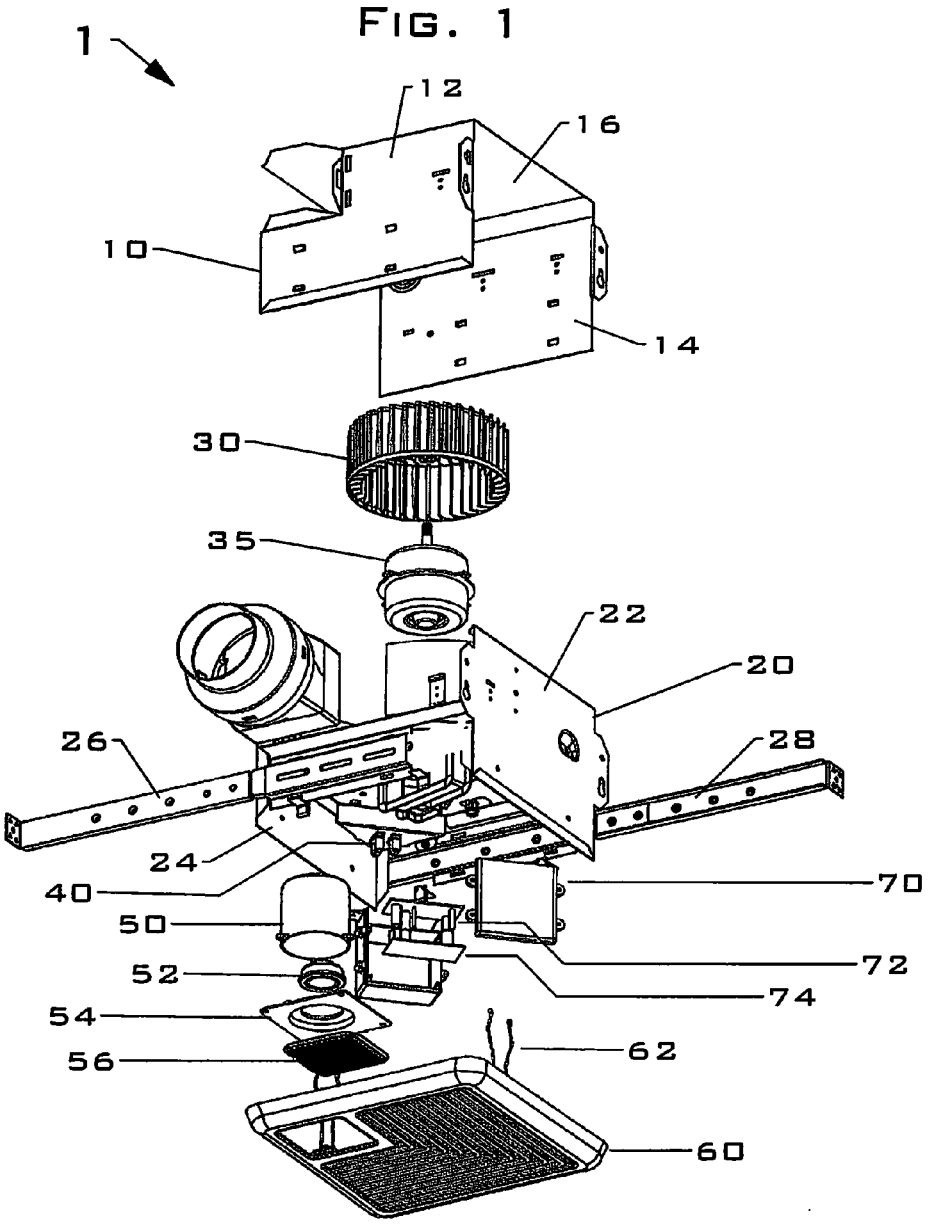
FIG. 1 is exploded view of the ceiling mounted ventilation fan with wireless speaker.

1 bath fan with wireless speaker
10 top chassis (housing)
12 first side wall
14 second side wall
16 top wall
20 bottom chassis
22 first side wall
24 second side wall
25 exhaust vent
26 first support beam
28 second support beam
30 Blower wheel
35 Motor
40 Junction box
50 Speaker enclosure
52 Speaker
54 Speaker mount
56 Speaker grill
60 Main grill
62 Spring clip
70 Enclosure for BT module and power converter
72 Wireless module (Bluetooth, Wi-Fi, Zigbee)
74 Power converter
100 smart phone
200 entertainment center FIG. 1 is exploded view of the ceiling mounted ventilation fan 1 with wireless speaker 52. A top chassis 10 and bottom chassis 20 can fit together by fasteners, such as screws and bolts to form a housing can. The top chassis can include a first side wall 12, a second side wall 14, attached to one another by a top wall 16. The bottom chassis 20 can include a first side wall 22 with first support beam such as telescoping legs with bent end flanges, and a second side wall 24 with a second support beam 28 such as telescoping legs with bent end flanges, the support beams 26, 28 for attaching the housing to support type joists in a ceiling above the ceiling fan 1.

A grill 60 can be attached to the housing chassis 10, 20 by a spring clip 62 The housing can pull air through vents in the grill 60 by the blower wheel 30 which is rotated by a rotatable axle portion of a motor 25, and exhaust air out of the housing by an exhaust vent 25.

The horizontally mounted blower wheel 30 with motor 35 extending partially out from underneath top chassis 10 and bottom chassis 20 of the housing and exhaust vent 25 with spring clip attached vented grill 60, can include components shown and described in related U.S. patent application Ser. No. 13/042,992 filed Mar. 8, 2011 now U.S. Pat. No. 9,175,874; Ser. No. 13/168,112 filed Jun. 24, 2011 now U.S. Pat. No. 9,022,846; Ser. No. 13/219,326 filed Aug. 26, 2011; Ser. No. 13/233,700 filed Sep. 15, 2011 now U.S. Pat. No. 9,097,265; Ser. No. 13/237,544 filed Sep. 20, 2011 now U.S. Pat. No. 8,961,126; Ser. No. 13/269,171 filed Oct. 7, 2011 now U.S. Pat. No. 9,103,104; and Ser. No. 13/289,312 filed Nov. 4, 2011, now U.S. Pat. No. 9,028,212, which are all assigned to the same assignee as the subject patent application, and which are all incorporated by reference in their entireties.

Figure 2:
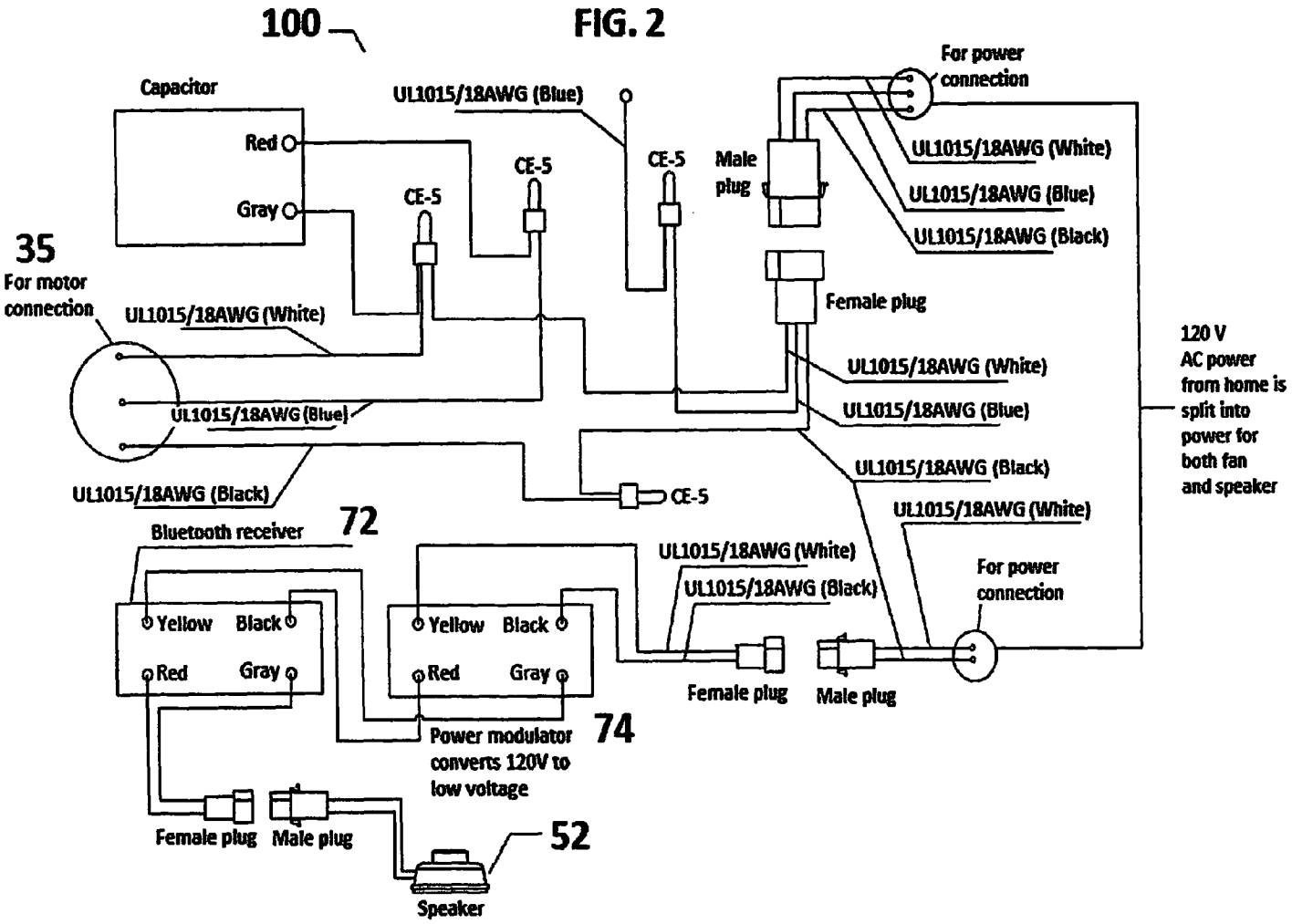
FIG. 2 shows the circuitry used in the ventilation fan with wireless speaker of FIG. 1.

FIG. 2 shows the circuitry 100 used in the ventilation fan 1 with wireless speaker 52 of FIG. 1.

Referring to FIGS. 1-2, the assembled bath fan 1 includes a wireless speaker system 52 integrated into a bathroom ventilation fan 1. Combining these two systems together will save space in often small rooms. Also, the combination will only require a single installation as opposed to two separate installations. The speaker 52 can use the same power source 120 volt AC that can be split into a power source for both the ventilation fan motor 35 and blower wheel 30 and wireless receiver 72 so that no new wiring is required by consumer. The speaker 52 can be located in front of the ventilation fan blower wheel 60, removing risk of sound distortion by blade movement of the blower wheel 60.

Referring to FIG. 1, on a horizontal plane, the speaker 52 and enclosure 50 below (in front of) the blower wheel eliminating any distortion covered by the blower wheel. In essence, the speaker generates sounds downward in to the room below, without the sounds passing through the blower wheel. Although FIG. 1 shows the speaker enclosure to one side corner of the grill 60, the speaker enclosure can be in any location in the grill 60 such as other corners, or in the middle of the grill 60, as long as the speaker enclosure 50 is between the blower 30 and the grill 60

The speaker unit 52 can include a wireless receiver 72, amplifier, and at least one speaker 52, and a remotely located transmitter 100/200. A wireless transmitter 100/200, such as but not limited to a Bluetooth transmitter can be remotely located on an entertainment system 200, or portable electronics device 100, such as but not limited to a smart phone, which sends wireless signals to the receiver 72, which then transmits the signals through the speaker 52.

A smaller speaker grill 56 can be mounted to one side corner of the main grill 60. A speaker mount 54 can support a speaker 52 in a speaker enclosure 50 such as a cylindrical container. An enclosure 70 having a lid covering an open end of a box portion can enclose a Bluetooth module 72, a power converter 74, along with a junction box 40.

The junction box can include male and female plugs for attaching and detaching power from a single power source to both the ventilation fan motor 35 and Bluetooth module 72 and wireless speaker 52.

The speaker enclosure 50 can be cylindrical container having closed top, closed sides and bottom opening for supporting a rear end of a speaker 52 by a speaker mount 54 with a separate speaker grill 56 in the main grill 60 for the speaker. Enclosure 50 can be other shapes, such as but not limited to box shaped, and the like. The speaker enclosure 50, and speaker mount 54 prevents incoming air through the grill 60 from passing about the speaker 52.

Figure 3:
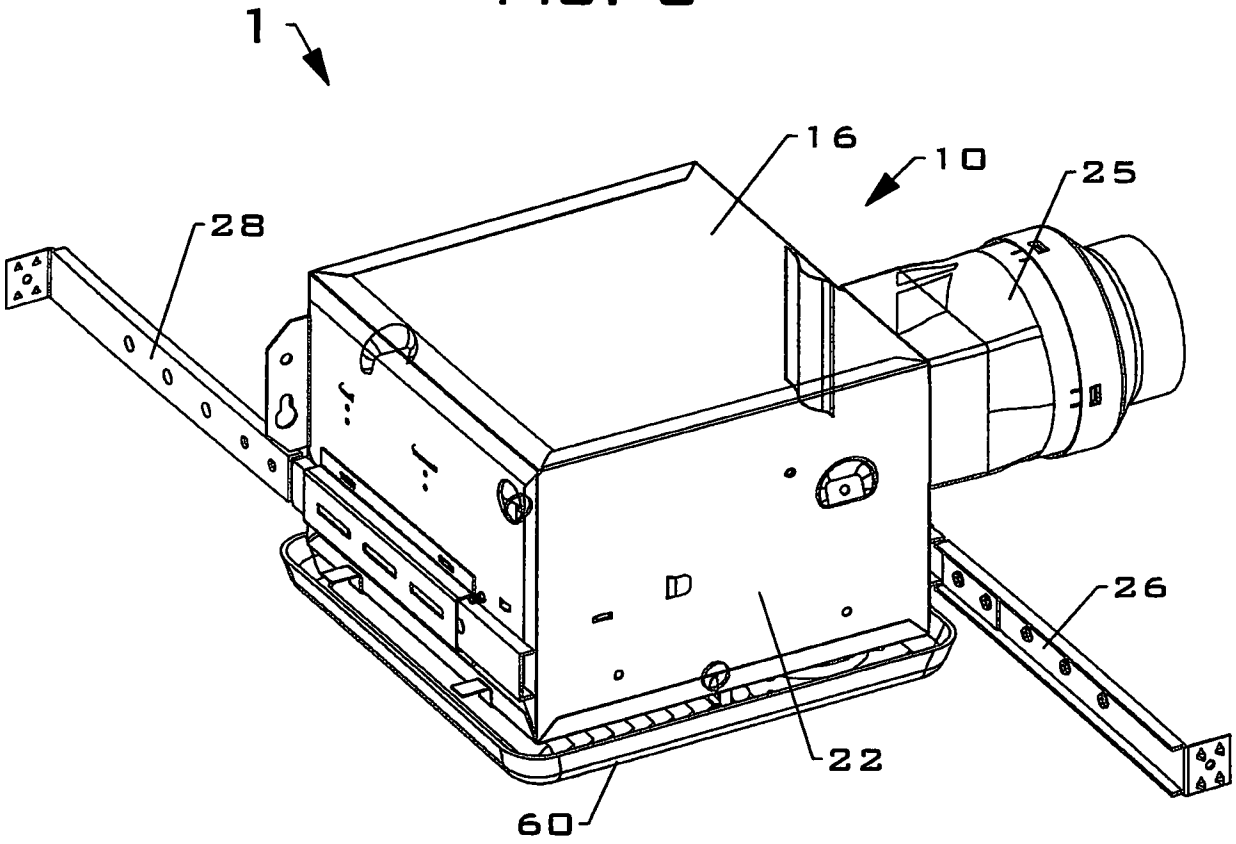
FIG. 3 is an upper front perspective view of an assembled ventilation fan with speaker of FIG. 1.
Figure 4:
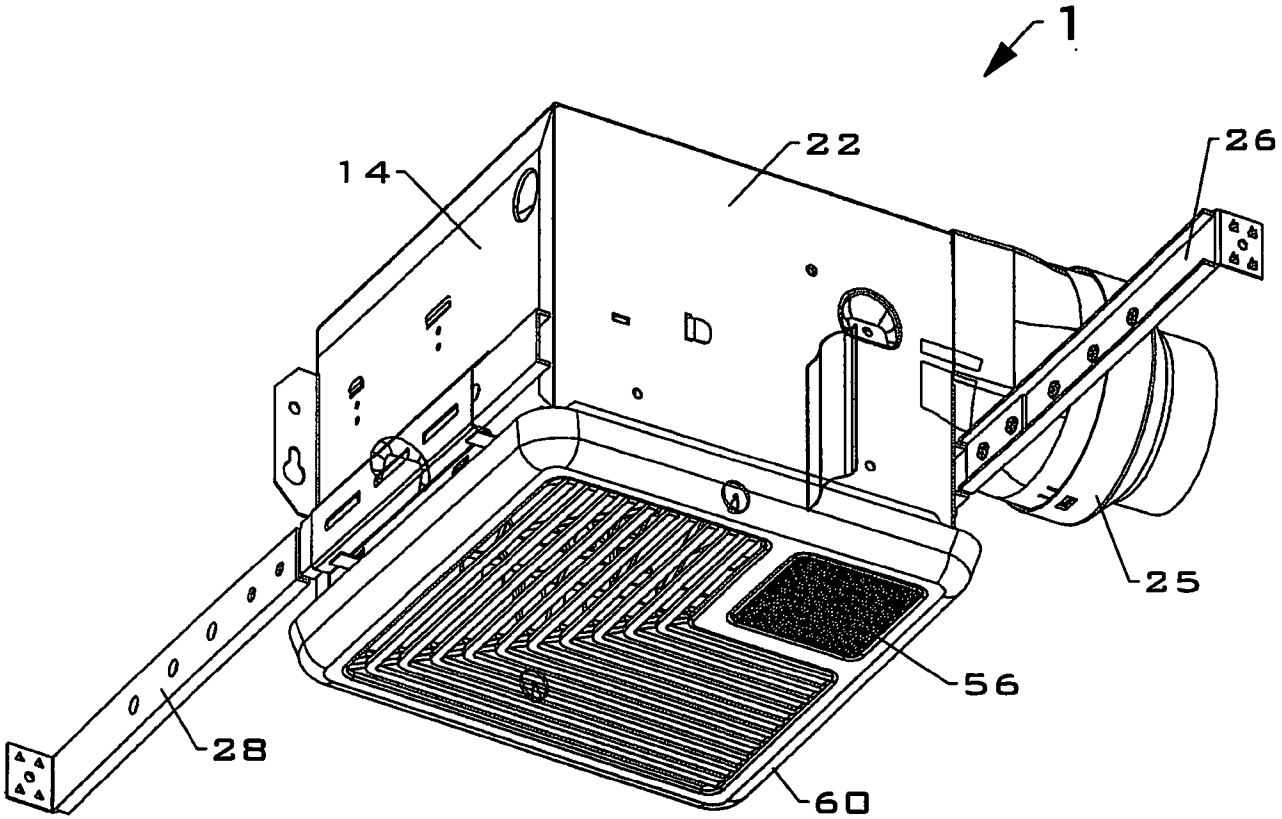
FIG. 4 is a lower perspective view of an assembled ventilation fan with speaker of FIG. 3.
Figure 5:
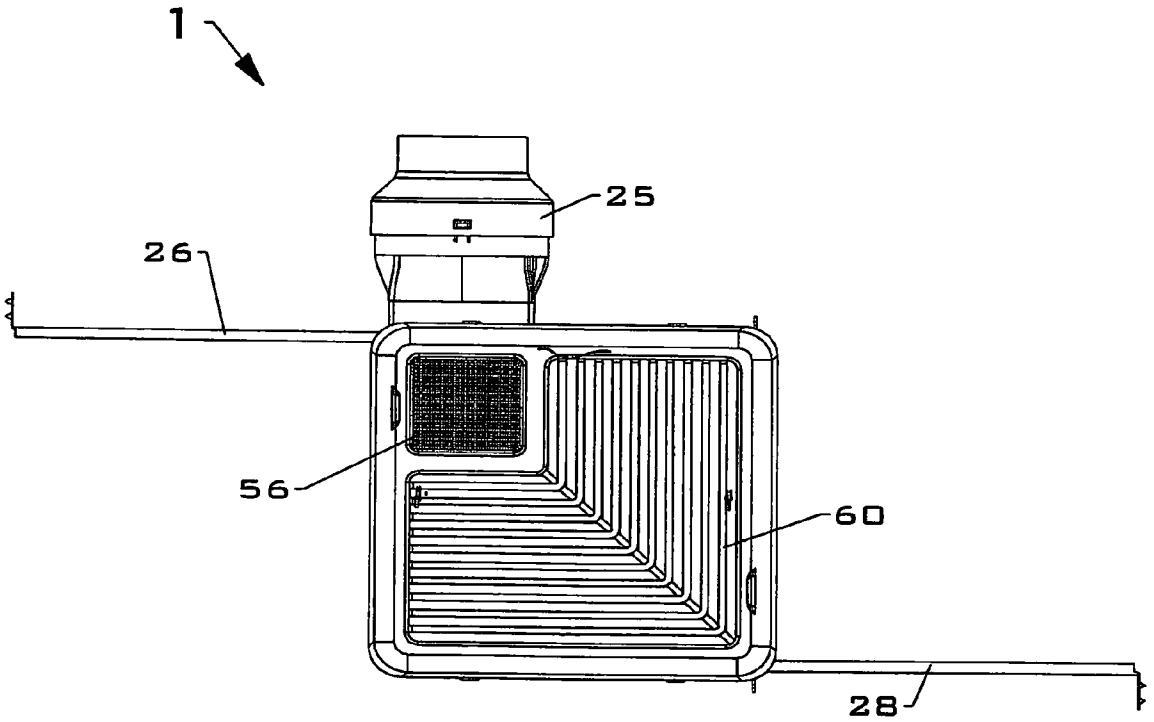
FIG. 5 is a bottom view of an assembled ventilation fan with speaker of FIG. 3.
Figure 6:
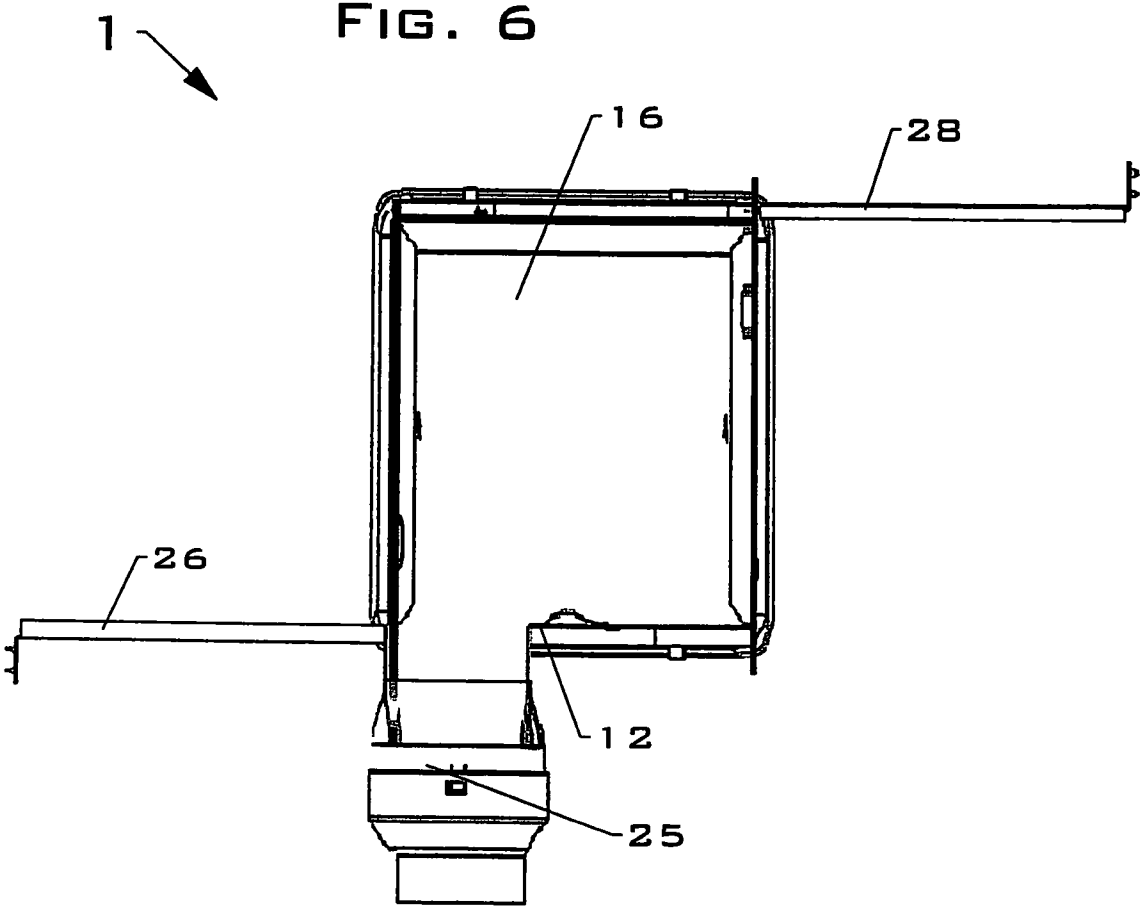
FIG. 6 is a top view of an assembled ventilation fan with speaker of FIG. 3.
Figure 7:
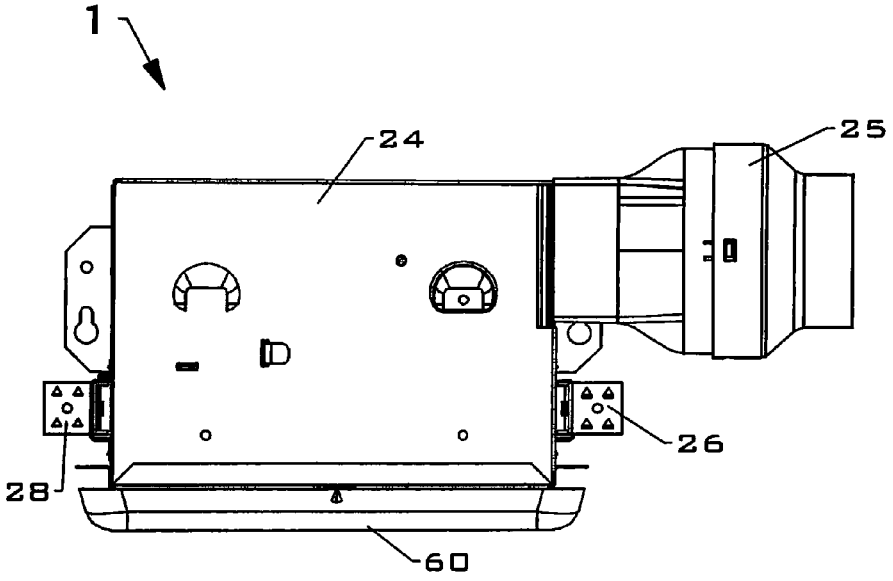
FIG. 7 is a front view of an assembled ventilation fan with speaker of FIG. 3.

FIG. 3 is an upper front perspective view of an assembled ventilation fan 1 with speaker 52 behind grill 60 of FIG. 1. FIG. 4 is a lower perspective view of an assembled ventilation fan 1 with speaker 52 behind grill 60 of FIG. 3. FIG. 5 is a bottom view of an assembled ventilation fan 1 with speaker 52 behind grill 60 of FIG. 3. FIG. 6 is a top view of an assembled ventilation fan 1 with speaker of FIG. 3. FIG. 7 is a front view of an assembled ventilation fan with speaker of FIG. 3.

Figure 8A:
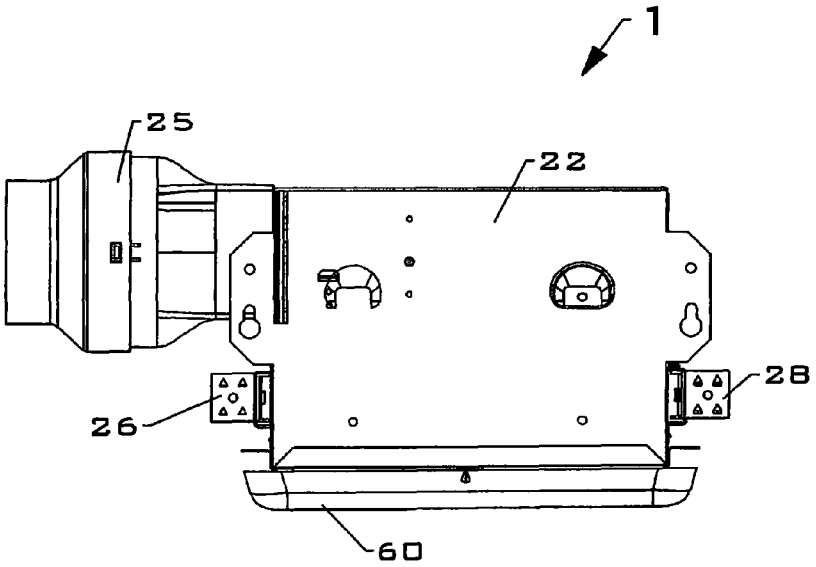
FIG. 8A is a rear view of an assembled ventilation fan with speaker of FIG. 3.
Figure 8B:
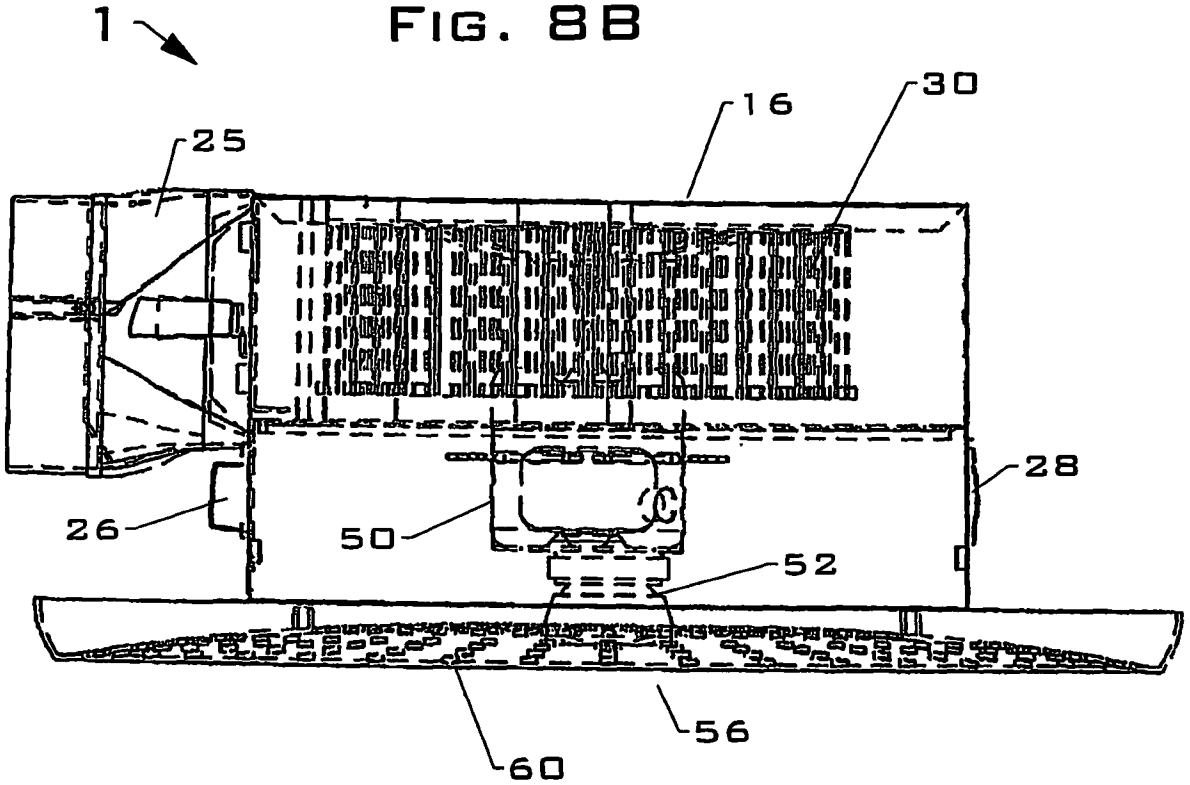
FIG. 8B is a cross-sectional ghosted rear view of the assembled ventilation fan with speaker of FIG. 8A.

FIG. 8A is a rear view of an assembled ventilation fan 1 with speaker 52 of FIG. 3. FIG. 8B is a cross-sectional ghosted rear view of the assembled ventilation fan 1 with speaker 52 in grill 60 of FIG. 8A.

Figure 9:
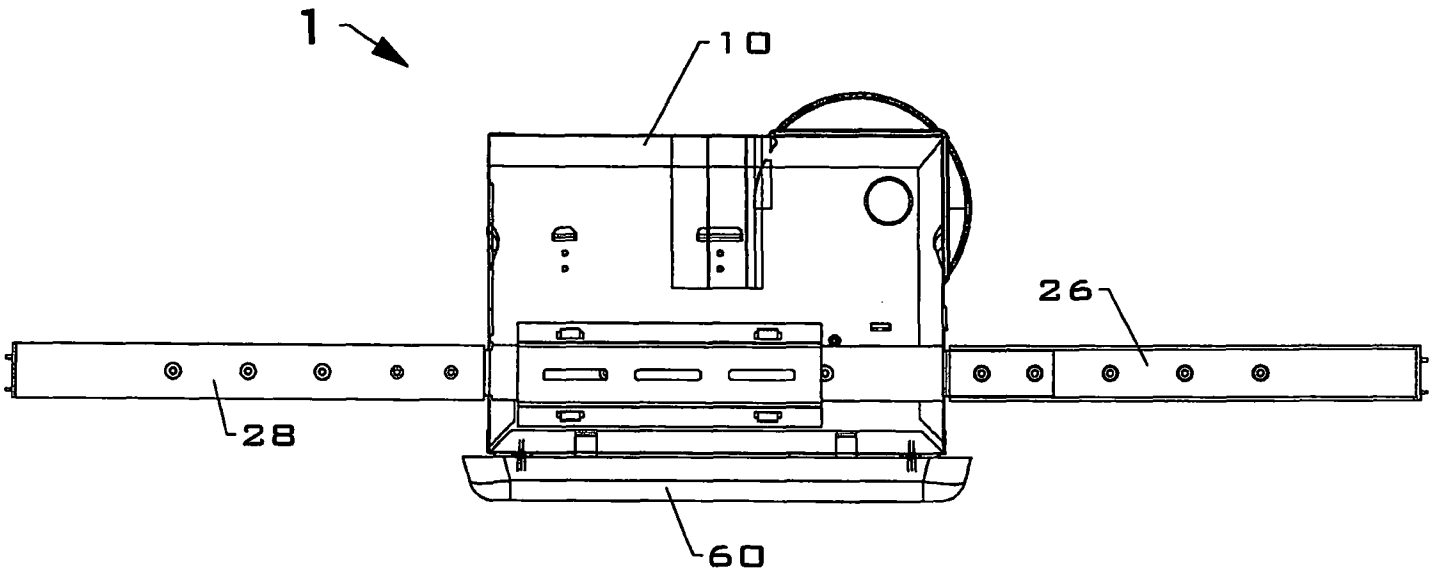
FIG. 9 is a left side view of an assembled ventilation fan with speaker of FIG. 3.

FIG. 9 is a left side view of an assembled ventilation fan 1 with speaker of FIG. 3.

Figure 10A:
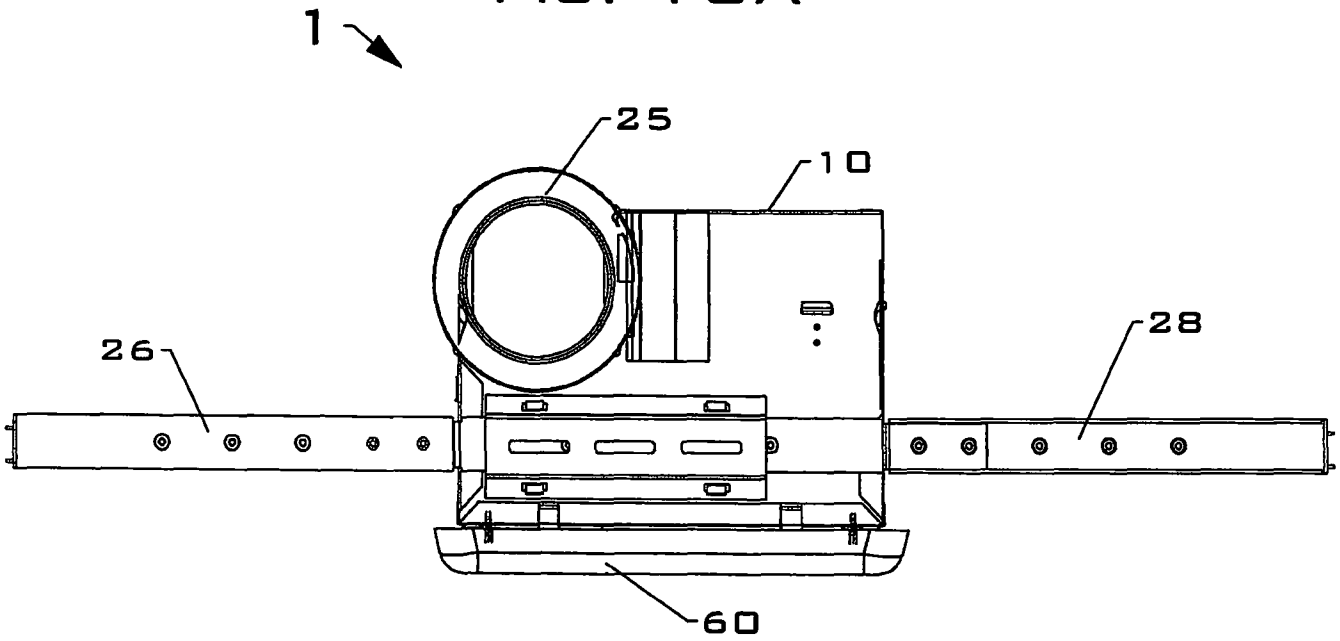
FIG. 10A is a right side view of an assembled ventilation fan with speaker of FIG. 3.
Figure 10B:
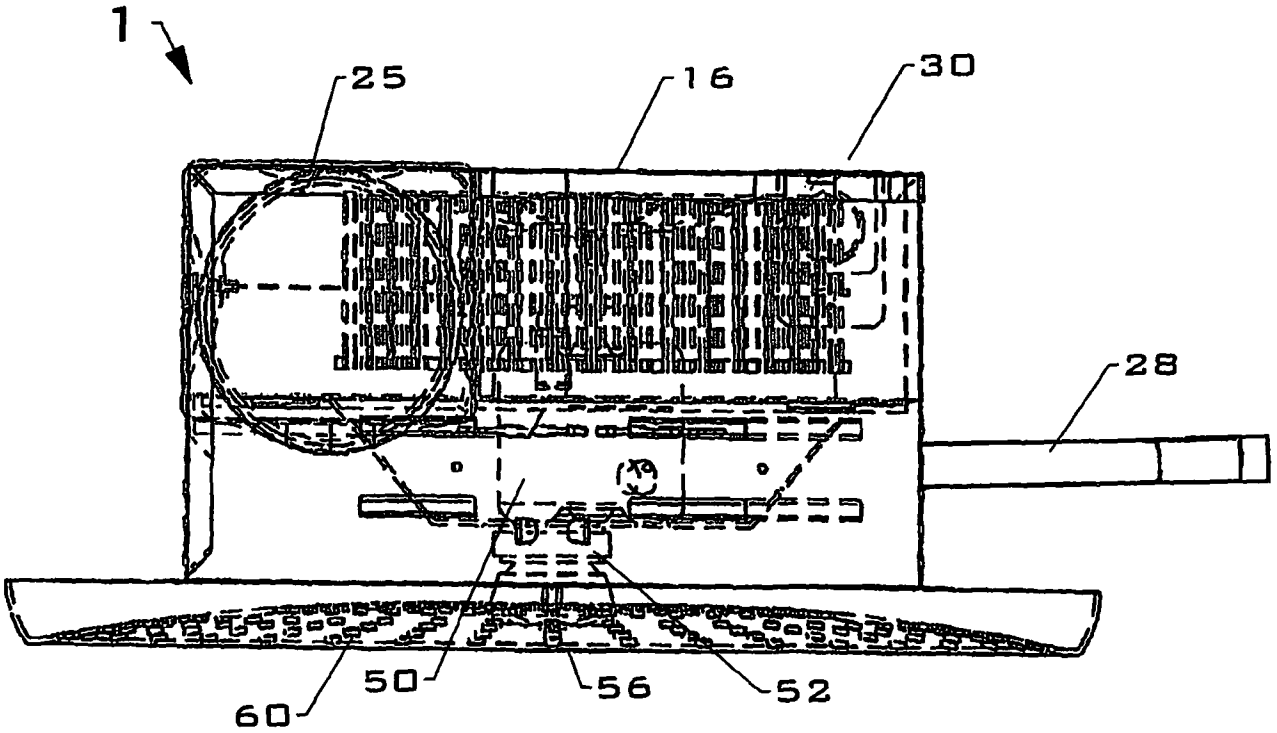
FIG. 10B is a cross-sectional ghosted right side view of the assembled ventilation fan with speaker of FIG. 10A.

FIG. 10A is a right side view of an assembled ventilation fan 1 with speaker 52 of FIG. 3. FIG. 10B is a cross-sectional ghosted right side view of the assembled ventilation fan 1 with speaker 52 of FIG. 10A.

Referring to FIGS. 1-10B invention allows a consumer to use a wireless speaker 52 configured for use with bathroom ventilation fan 1. Combining these two systems together will save space in often small rooms. Also, the combination will only require a single installation opposed to two separate installations.

The speaker can use the same household 120 volt AC power source as ventilation fan 1 so no new wiring is required by consumer.

The speaker 52 can be located in front of the ventilation fan 1, removing risk of sound distortion by blade movement. Incoming air passing through the vented grill 60 is to the side of the speaker enclosure 50 with speaker 52. The speaker unit includes a wireless receiver 72/transmitter, amplifier, and at least one speaker 52.

Although the wireless technology references Bluetooth, the invention can work with other wireless technology such as but not limited to Wi-Fi, Bluetooth and Zigbee.

The invention can use separate controls such as such as a separate remote control for operating the wireless speaker separately from the ventilation fan in the bath fan.

Although the invention generally describes generating music through the speaker(s) 52, the novel invention can work with a public address (PA) system remotely providing messages to the wireless speaker 52. For example, a home/building having separate wireless speakers in different bathrooms and other rooms can be interconnected with a public address system.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling mounted ventilation fan with speaker system comprising:

a single housing having sides, top and an open bottom;

a fan inside of the housing for drawing air through the open bottom into the housing and exhausting air from the housing;

a motor for operating the fan;

a speaker inside of the housing in front of the fan;

a main rectangular grill having four sides covering the open bottom of the housing; the main rectangular grill having four corners between each of the four sides, the main grill having parallel louvers running up to substantially three of the four corners of the main grill;

a separate rectangular speaker grill having four sides being directly mounted in one corner of the main rectangular grill without the louvers, each of the four sides of the rectangular speaker grill being parallel to each of the four sides of the main speaker grill;

a speaker mount and enclosure for mounting the speaker behind the separate rectangular speaker grill; and a single power source for providing power to both the motor and the wireless speaker, wherein the mount, the enclosure and location of the speaker prevents incoming air through the main rectangular grill from passing about the speaker.

2. The ceiling mounted ventilation fan of claim 1, further comprising:

an enclosure for the speaker.

3. The ceiling mounted ventilation fan of claim 1, wherein the wireless speaker includes a transmitter and receiver operating with a wireless technology, selected from the group consisting of Wi-Fi, Bluetooth and Zigbee.

4. The ceiling mounted ventilation fan of claim 1, further comprising:

a control for operating the wireless speaker separately from the fan.

5. The ventilation fan of claim 1, further comprising:

a remote control for operating the wireless speaker separately from the fan.

6. The ventilation fan of claim 1, further comprising:

a home entertainment system remotely supplying music to the speaker.

7. The ventilation fan of claim 1, further comprising:

a public address (PA) system remotely providing messages to the wireless speaker.

8. The ventilation fan of claim 1, further comprising:

a single power supply for supplying power to both the fan and wireless speaker inside the single housing.

9. The ventilation fan of claim 8, further comprising:

an enclosure inside the single housing for enclosing both a wireless receiver module and a power converter.

10. The ventilation fan of claim 9, further comprising:

a junction box for connecting the supplied power to both the fan and the wireless speaker.

11. The ventilation fan of claim 10, further comprising:

male and female plugs for attaching and detaching the supplied power to both the fan and the wireless speaker.

12. The ventilation fan of claim 1, wherein the housing includes:

a top chassis and a bottom chassis attached to one another.

13. The ventilation fan of claim 12, wherein the top chassis includes:

a first side wall;

a second side wall spaced opposite to and parallel to the first side wall; and a top wall for attaching the first side wall to the second side wall.

14. The ventilation fan of claim 13, wherein the bottom chassis includes:

a first side wall;

a second side wall spaced opposite to and parallel to the first side wall;

a first support beam for attaching one side edge of the first side wall to one side edge of the second side wall; and a second support beam for attaching another side edge of the first side wall to another side edge of the second side wall.

15. The ventilation fan of claim 1, wherein the ventilation fan is a bath fan.

16. The ventilation fan of claim 15, wherein the bath fan includes a blower wheel.

17. The ventilation fan of claim 1, wherein the parallel louvers include:

a first set of parallel louvers having a first end and a second end; and a second set of parallel louvers having a first end and a second end being perpendicular to the first set of parallel louvers, the second set of parallel louvers starting adjacent to the second end of the first set of parallel louvers.

18. The ventilation fan of claim 1, wherein the speaker grill includes: a frame about the speaker grill for separating the speaker grill from the louvers.

19. A ceiling ventilation fan and speaker, comprising:

a housing with sides, top and an open bottom;

a fan inside the housing for drawing air through the open bottom into the housing and exhausting air therefrom;

a motor for operating the fan;

a speaker inside the housing;

a main rectangular grill having four sides covering the open bottom of the housing; the main rectangular grill having four corners between each of the four sides, the main grill having parallel louvers running up to substantially three of the four corners of the main grill, the parallel louvers including a first set of parallel louvers having a first end and a second end, and a second set of parallel louvers having a first end and a second end being perpendicular to the first set of parallel louvers, the second set of parallel louvers starting adjacent to the second end of the first set of parallel louvers;

a rectangular speaker grill having four sides being mounted in one corner of the main rectangular grill without the louvers, each of the four sides of the rectangular speaker grill being parallel to each of the four sides of the main speaker grill, the speaker grill including an outer frame separating the speaker grill from the louvers in the main grill;

a speaker mount and enclosure for mounting the speaker behind the separate rectangular speaker grill; and a power source for providing power to the motor and the wireless speaker, wherein the mount, the enclosure and location of the speaker prevents incoming air through the main rectangular grill from passing about the speaker.

* * * * *